US010661141B1

(12) United States Patent
Boisture

(10) Patent No.: US 10,661,141 B1
(45) Date of Patent: May 26, 2020

(54) TACKLING APPARATUS

(71) Applicant: Athletic Technologies LLC, Grand Blanc, MI (US)

(72) Inventor: Martin Boisture, Grand Blanc, MI (US)

(73) Assignee: Athletic Technologies LLC, Grand Blanc, MI (US)

( * ) Notice: Subject to any disclaimer, the term of this patent is extended or adjusted under 35 U.S.C. 154(b) by 0 days.

(21) Appl. No.: 16/287,800

(22) Filed: Feb. 27, 2019

(51) Int. Cl.
*A63B 69/34* (2006.01)

(52) U.S. Cl.
CPC ..... *A63B 69/345* (2013.01); *A63B 2243/007* (2013.01)

(58) Field of Classification Search
CPC ..... A63B 69/345; A63B 2243/007
See application file for complete search history.

(56) References Cited

U.S. PATENT DOCUMENTS 3,337,217 A * 8/1967 Cummins ..... A63B 69/345 473/442
3,637,210 A * 1/1972 Brantley ..... A63B 69/345 473/443
5,688,196 A * 11/1997 O'Neil ..... A63B 63/06 473/439
6,375,584 B1 * 4/2002 Shapiro ..... A63B 69/002 473/419
9,879,949 B2 * 1/2018 Roemer ..... F41J 9/02

OTHER PUBLICATIONS

Penning, Craig, "evader tackling machine!" YouTube, Aug. 28, 2011, https://www.youtube.com/watch?v=a-mdJXIm4eY.

* cited by examiner

*Primary Examiner* — Jeffrey S Vanderveen
(74) *Attorney, Agent, or Firm* — Harness, Dickey & Pierce, P.L.C.

(57) ABSTRACT

An apparatus includes a pair of support members, a cable, a rolling mechanism and a tackling bag. The pair of support members are fixedly coupled to a surface. The cable is attached to and extends between the pair of support members. The rolling mechanism is connected to the cable and configured to traverse the rod from a first end of the rod toward a second end of the rod. The tackling bag is attached to the rolling mechanism and configured to be propelled from one of the pair of support members toward the other of the pair of support members. The rolling mechanism is permitted to move relative to the cable when a force is applied to the tackling bag.

15 Claims, 15 Drawing Sheets

TACKLING APPARATUS

FIELD

The present disclosure relates to a tackling apparatus.

BACKGROUND

This section provides background information related to the present disclosure and is not necessarily prior art.

Football (i.e., American Football) or rugby, for example, involves substantial player on player physical contact. As is known, player on player physical contact may result in injuries and repeated contact during practice may elevate the risk of player injury. As such, player on player contact during practice has been limited (or prevented altogether).

As a result of limited player on player physical contact during practice, tackling apparatuses (e.g., a tackling dummy) are used to teach players proper tackling techniques and form without the need for player on player physical contact. However, such tackling apparatuses are not reliable and do not accurately simulate live game tackling. The present disclosure provides a tackling apparatus that is reliable and accurate simulates live game tackling.

SUMMARY

This section provides a general summary of the disclosure, and is not a comprehensive disclosure of its full scope or all of its features.

In one form, the present disclosure provides an apparatus that includes a pair of support members, a first cable, a rolling mechanism and a tackling bag. The pair of support members are fixedly coupled to a surface. The first cable is attached to and extends between the pair of support members. The rolling mechanism is connected to the first cable and is configured to traverse the first cable from a first end of the first cable toward a second end of the first cable. The tackling bag is attached to the rolling mechanism and is configured to be propelled from one of the pair of support members toward the other of the pair of support members. The rolling mechanism is permitted to move relative to the first cable when a force is applied to the tackling bag.

In some configurations of the apparatus of the above paragraph, a second cable extending between the pair support members, and wherein the rolling mechanism is connected to the second cable and configured to traverse the second cable.

In some configurations of the apparatus of any one or more of the above paragraphs, a first pulley system is associated with the one of the pair of support members and a second pulley system is associated with the other of the pair of support members. The second cable extends around the first and second pulley systems.

In some configurations of the apparatus of any one or more of the above paragraphs, a first stack of weights is attached to a pulley device of the first pulley system and a second stack of weights is attached to another pulley device of the second pulley system. The first and second stack of weights cooperate to act as a counterbalance to the tackling bag such that the tackling bag is suspended above the surface prior to the force being applied to the tackling bag.

In some configurations of the apparatus of any one or more of the above paragraphs, the rolling mechanism includes first, second and third wheel housings and a pulley device. The first wheel housing is attached to the second and third wheel housings and is configured to traverse the first cable. The second and third wheel housings and the pulley device are configured to traverse the second cable.

In some configurations of the apparatus of any one or more of the above paragraphs, the pulley device is configured to move in a vertical direction relative to the first cable and the first, second and third wheel housings when the force is applied to the tackling bag.

In some configurations of the apparatus of any one or more of the above paragraphs, the pulley device is positioned between the second and third wheel housings.

In some configurations of the apparatus of any one or more of the above paragraphs, the second cable moves in a vertical direction relative to the first cable and the first, second and third wheel housings when the force is applied to the tackling bag.

In some configurations of the apparatus of any one or more of the above paragraphs, the pulley device is removably attached to the first wheel housing via a clip.

In some configurations of the apparatus of any one or more of the above paragraphs, the tackling bag is attached to the rolling mechanism via an attachment assembly.

In some configurations of the apparatus of any one or more of the above paragraphs, a stretchable shroud covers the attachment assembly.

In another form, the present disclosures provides an apparatus that includes a pair of support members, a cable, a rolling mechanism, a tackling bag and a sensor. The pair of support members are fixedly coupled to a surface. The cable is attached to and extends between the pair of support members. The rolling mechanism is connected to the cable and is configured to traverse the cable from a first end of the cable toward a second end of the cable. The tackling bag is attached to the rolling mechanism and is configured to be propelled from one of the pair of support members toward the other of the pair of support members. The sensor is associated with the tackling bag and is configured to measure a parameter that is indicative of a force applied to the tackling bag. The rolling mechanism is permitted to move relative to the cable when the force is applied to the tackling bag.

In some configurations of the apparatus of the above paragraph, the parameter is an acceleration of the tackling bag.

In some configurations of the apparatus of any one or more of the above paragraphs, a control module is in communication with the sensor. The control module is configured to receive data from the sensor that includes the parameter that is indicative of the force applied to the tackling bag.

In some configurations of the apparatus of any one or more of the above paragraphs, a notification system is in communication with the control module. The notification system receives and stores the data from the control module.

In some configurations of the apparatus of any one or more of the above paragraphs, the notification system is configured to generate an alert when a record force is applied to the tackling bag.

In some configurations of the apparatus of any one or more of the above paragraphs, the notification system is a smartphone or a tablet.

In yet another form, the present disclosure provides an apparatus that include one or more tackling bags, a sensor associated with each tackling bag of the one or more tackling bags and one or more control modules. Each sensor is configured to measure a parameter that is indicative of a force applied to a respective tackling bag. Each control module is in communication with a respective sensor and is configured to receive data from the respective sensor that includes the parameter that is indicative of the force applied to the respective tackling bag.

In some configurations of the apparatus of the above paragraph, a notification system is in communication with the one or more control modules. The notification system receives and stores data from the one or more control modules.

In some configurations of the apparatus of any one or more of the above paragraphs, the notification system is configured to generate an alert when a record force is received by one of the one or more control modules.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
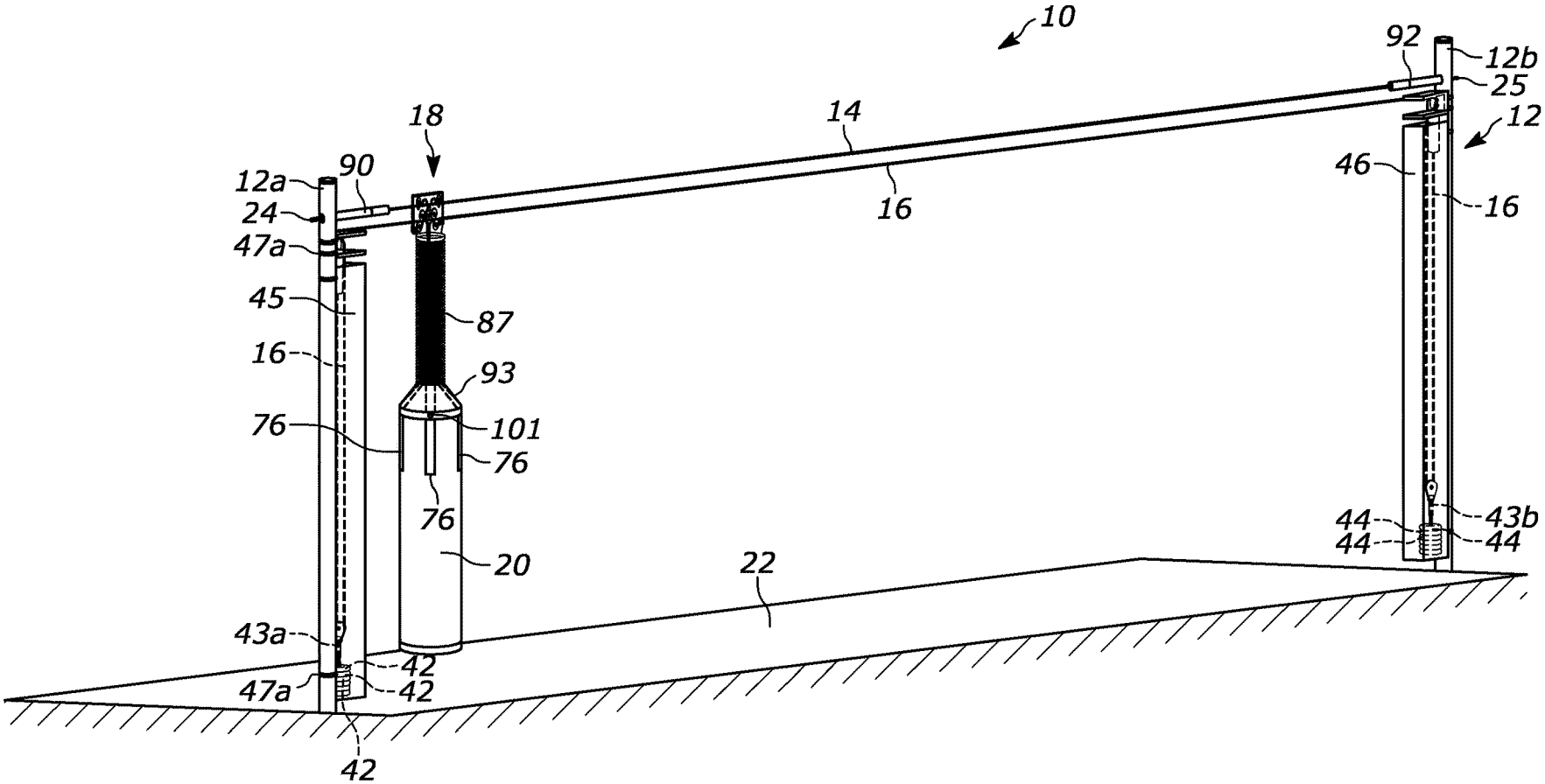
FIG. 1 is a perspective view of a tackling apparatus according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
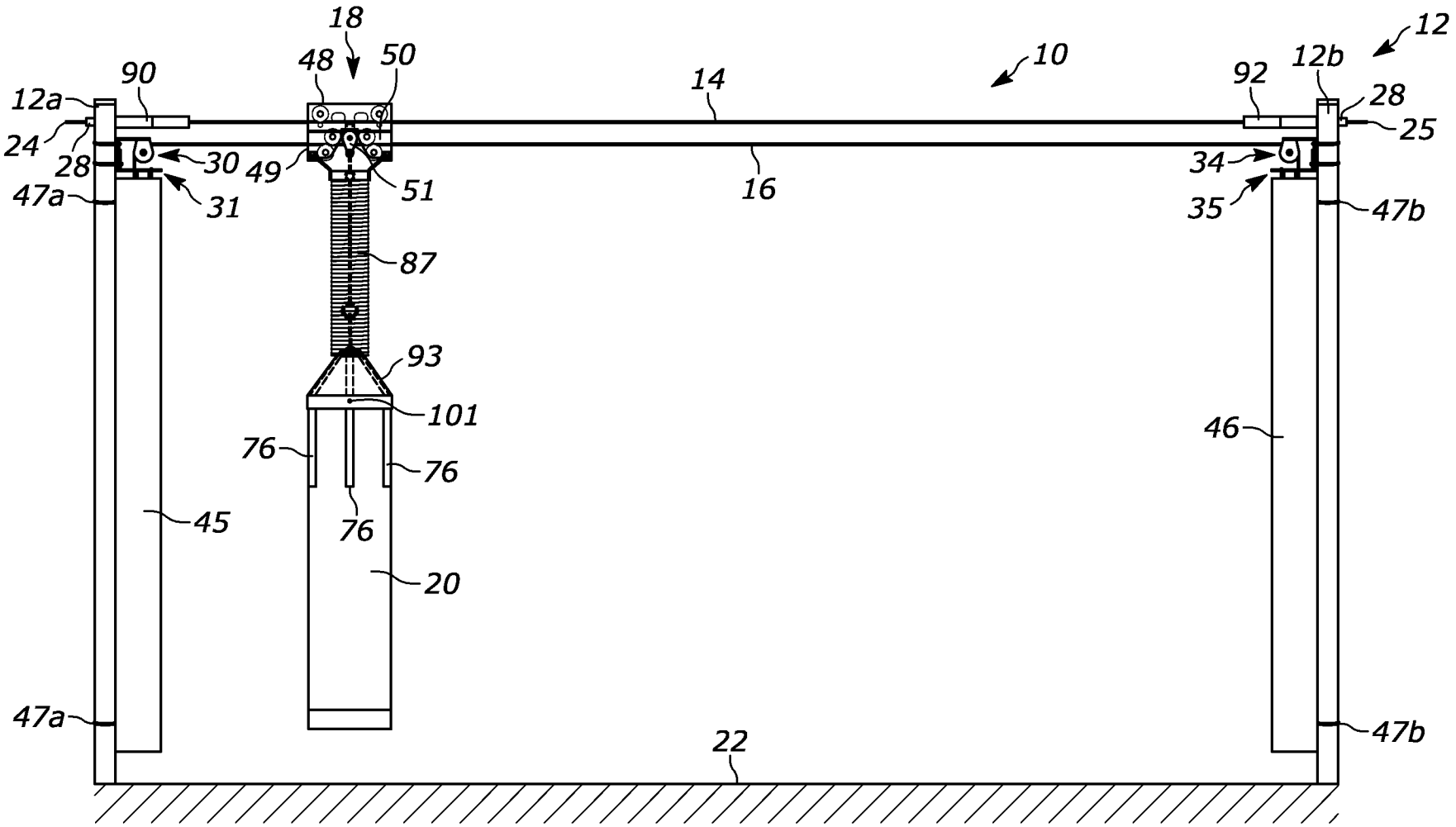
FIG. 2 is a front view of the tackling apparatus shown in FIG. 1 prior to a tackling bag of the tackling apparatus being propelled and tackled.

As shown in FIGS. 1 and 2, an apparatus 10 is provided that may include a pair of elongated support structures or members 12 (comprised of support member 12*a* and support member 12*b*), first and second cables 14, 16, a trolley or rolling mechanism 18 and an elongated tackling bag or body 20. The pair of support members 12 may be fixedly coupled to a surface 22 and may be aligned with each other. Each support member 12*a*, 12*b* may be cylindrically-shaped and may be made of a metallic material, for example. In some configurations, the pair of support members 12 may be telescoping such that a height that the tackling bag 20 is suspended above the surface 22 may be adjustable.

As shown in FIGS. 1 and 2, the first cable 14 may extend between the pair of support members 12 and may support the rolling mechanism 18. The first cable 14 may be rigid. With reference to FIGS. 1-6, a first end 24 of the first cable 14 may extend through an aperture (not shown) of the support member 12*a* (FIGS. 1-4) and a second end 25 of the first cable 14 may extend through an aperture (not shown) of the support member 12*b* (FIGS. 1, 2, 5 and 6). A fastening member 28 (e.g., locking nut) may be secured to the first and second ends 24, 25 of the first cable 14 to attach the first cable 14 to the pair of support members 12.

Figure 3:
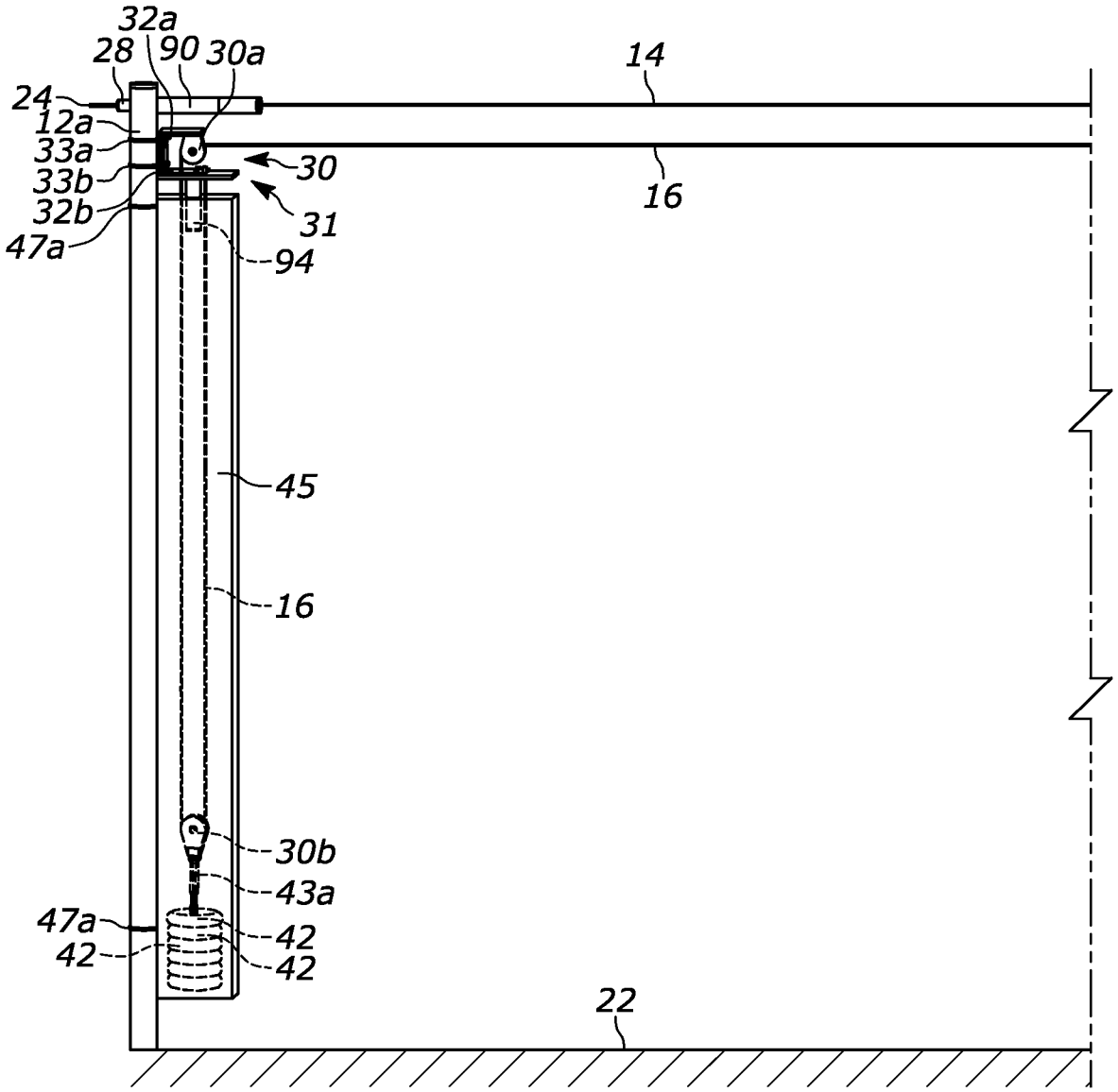
FIG. 3 is a front view of a first pulley system and a first support member of the tackling apparatus shown in FIG. 1.
Figure 4:
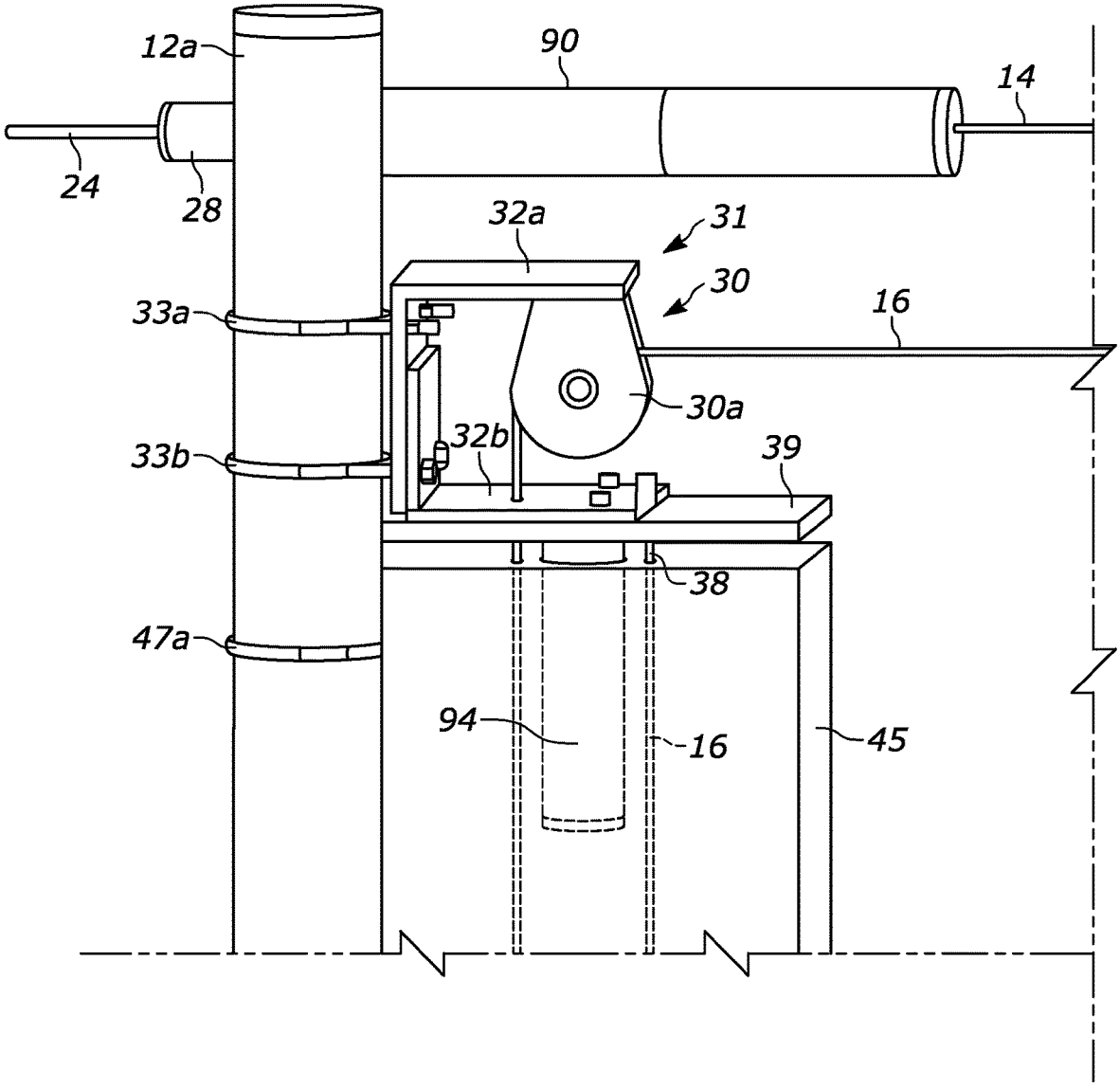
FIG. 4 is a front view of a bracket assembly of the tackling apparatus shown in FIG. 1.

With reference to FIGS. 3 and 4, a first pulley system 30 may be associated with the support member 12*a* and may include pulley devices 30*a*, 30*b*. The pulley device 30*a* may be attached to a bracket assembly 31, which, in turn, is coupled to the support member 12*a* at or near an upper end thereof. The bracket assembly 31 may include first and second L-shaped brackets 32*a*, 32*b* and a plurality of connecting members 33*a*, 33*b* (e.g., saddle clamps). The pulley device 30*a* may be attached to the first bracket 32*a*, which, in turn, is coupled to the support member 12*a* via the connecting member 33*a*. The second bracket 32*b* may be attached (e.g., welded) to the first bracket 32*a* and may be coupled to the support member 12*a* via the connecting member 33*b*.

Figure 5:
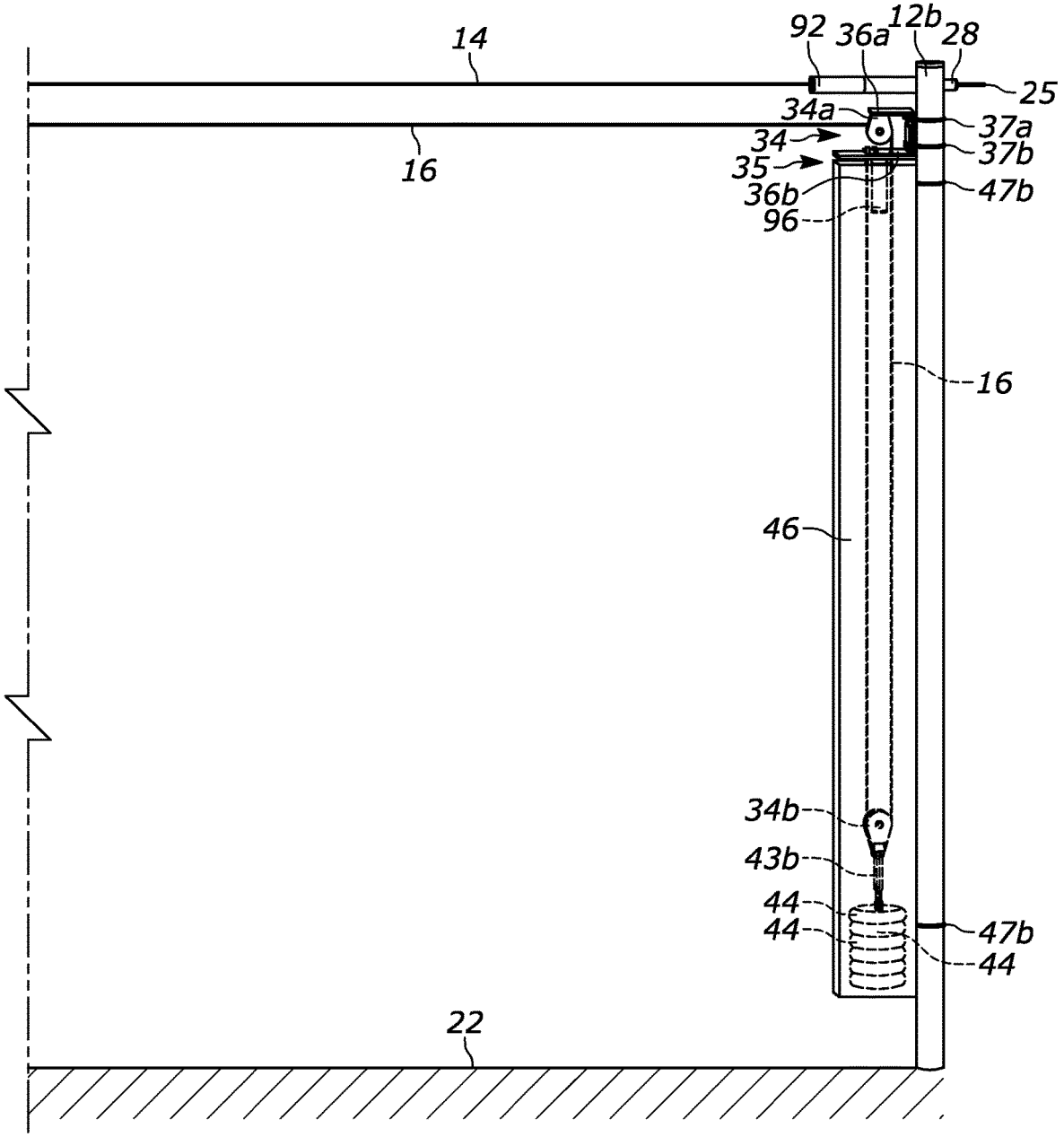
FIG. 5 is a front view of a second pulley system and a second support member of the tackling apparatus shown in FIG. 1.
Figure 6:
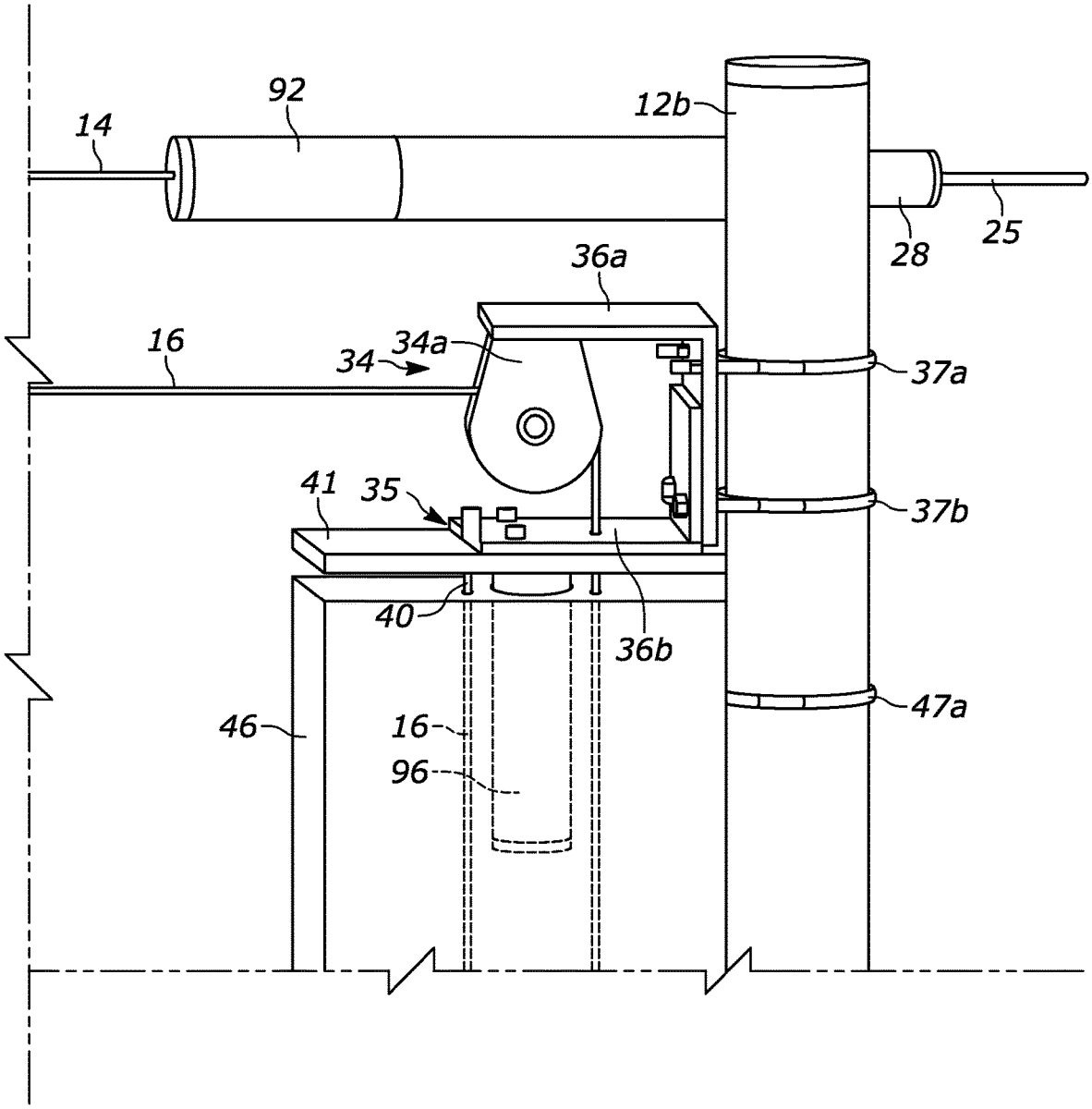
FIG. 6 is a front view of another bracket assembly of the tackling apparatus shown in FIG. 1.

With reference to FIGS. 5 and 6, a second pulley system 34 may be associated with the support member 12*b* and may include pulley devices 34*a*, 34*b*. The pulley device 34*a* may be attached to a bracket assembly 35, which, in turn, is coupled to the support member 12*b* at or near an upper end thereof. The bracket assembly 35 may include first and second L-shaped brackets 36*a*, 36*b* and a plurality of connecting members 37*a*, 37*b* (e.g., saddle clamps). The pulley device 34*a* may be attached to the first bracket 36*a*, which, in turn, is coupled to the support member 12*b* via the connecting member 37*a*. The second bracket 36*b* may be attached (e.g., welded) to the first bracket 36*a* and may be coupled to the support member 12*b* via the connecting member 37*b*.

The second cable 16 is positioned below the first cable 14 and extends between the pair of support members 12. The second cable 16 may have a length that is longer than a length of the first cable 14. The second cable 16 may support the bag 20 and may extend around the first pulley system 30 (FIG. 3) and the second pulley system 34 (FIG. 5). That is, the second cable 16 may extend around the pulley devices 30*a*, 30*b* and may include a first end portion 38 that is attached to a plate 39 fixed to the second bracket 32*b*. Similarly, the second cable 16 may extend around the pulley devices 34*a*, 34*b* and may include a second end portion 40 that is attached to a plate 41 fixed to the second bracket 36*b*.

With reference to FIGS. 1, 3, 5, 9, 13 and 14, stacked weights 42 may be attached to the pulley device 30*b* via an attachment assembly 43*a* (FIGS. 1, 3, 9 and 13) and stacked weights 44 may be attached to the pulley device 34*b* via an attachment assembly 43*b* (FIGS. 1, 5, 9 and 14). In this way, the stacked weights 42, 44 may cooperate to act as a counter balance to the body 20 such that the body 20 may be suspended above the surface 22 a predetermined distance (e.g., a foot) prior to the bag 20 being tackled. That is, if the body 20 is 20 lbs, each of the stacked weights 42, 44 may total 10 lbs, thereby counterbalancing the body 20 and suspending the body 20 above the surface 22 the predetermined distance prior to the body 20 being tackled. The stacked weights 42, 44 may also provide resistance to a tackler that is tackling the body 20, thereby accurately simulating live game tackling.

With reference to FIGS. 1, 3, 5, 9, 13 and 14, the stacked weights 42 and the portion of the second cable 16 extending adjacent to the support member 12*a* may be housed in a first housing 45 (FIGS. 1, 3, 9 and 13) and the stacked weights 44 and the portion of the second cable 16 extending adjacent to the support member 12*b* may be housed in a second housing 46 (FIGS. 1, 5, 9 and 14). The first housing 45 may be attached to the support member 12*a* via a plurality of connecting members 47*a* (e.g., saddle clamps) and the second housing 46 may be attached to the support member 12*b* via a plurality of connecting members 47*b* (e.g., saddle clamps).

Figure 9:
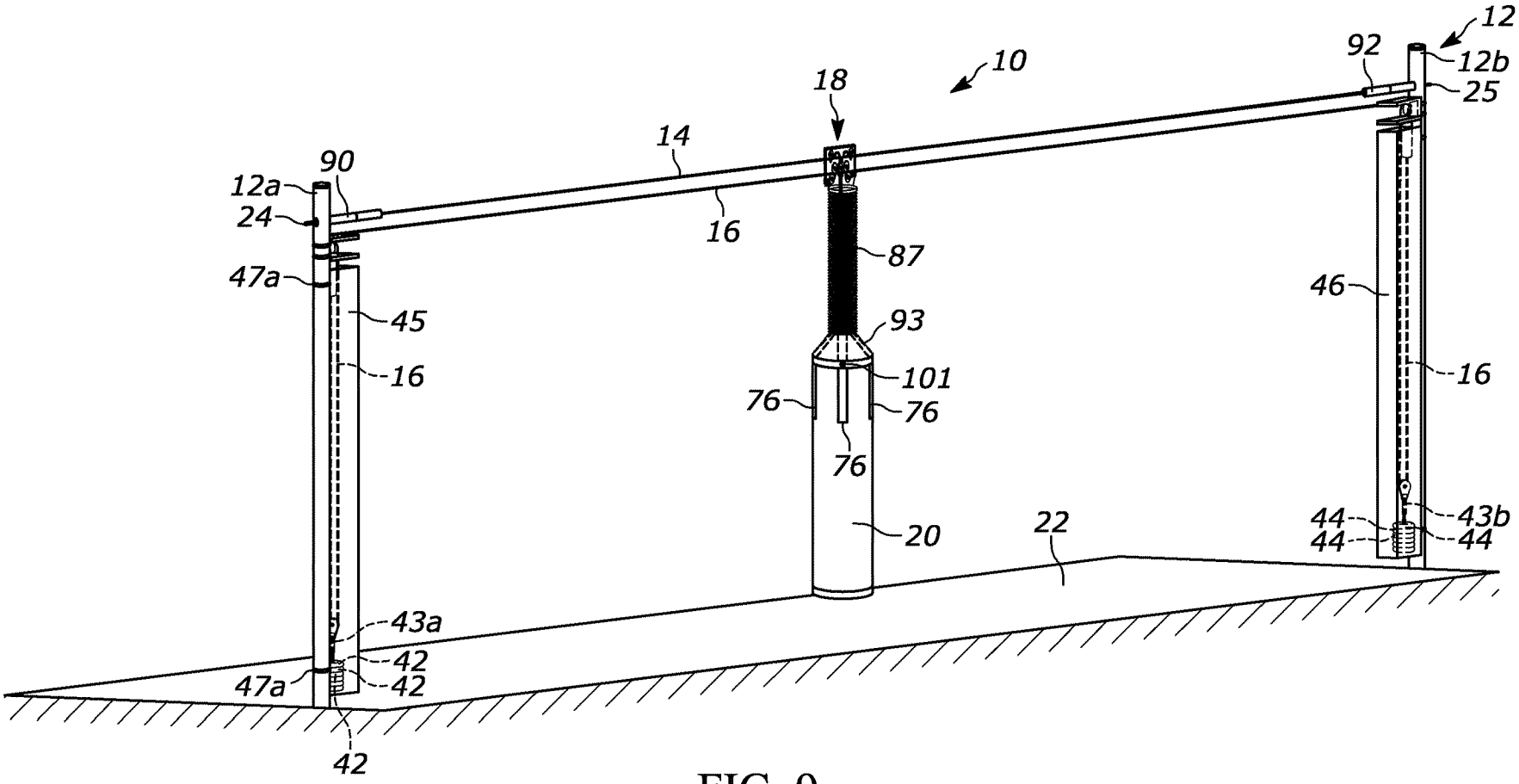
FIG. 9 is perspective view of the tackling apparatus with the tackling bag being propelled from the first support member toward the second support member and prior to the tackling bad being tackled.
Figure 10:
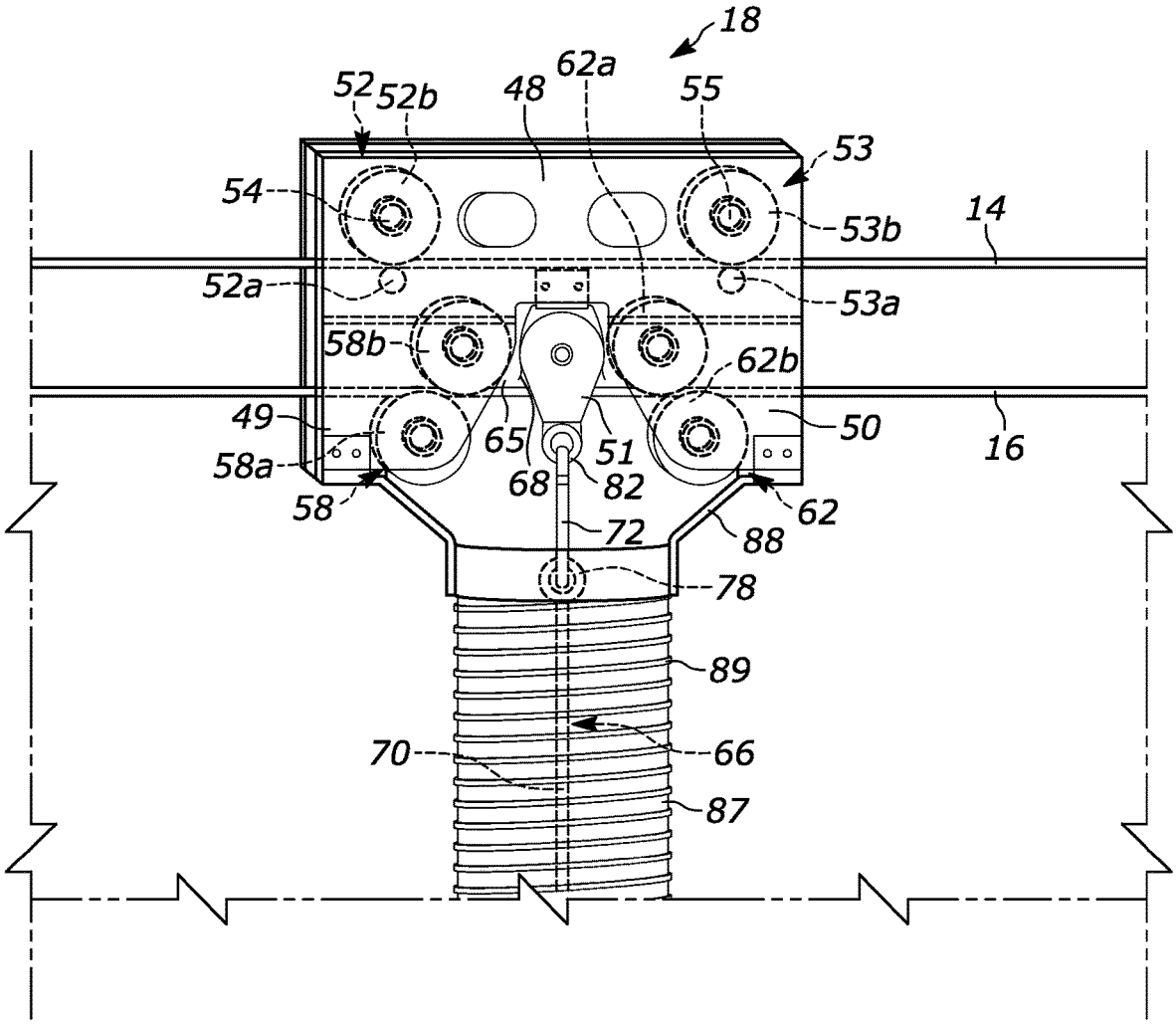
FIG. 10 is a front view of the trolley of FIG. 9.
Figure 11:
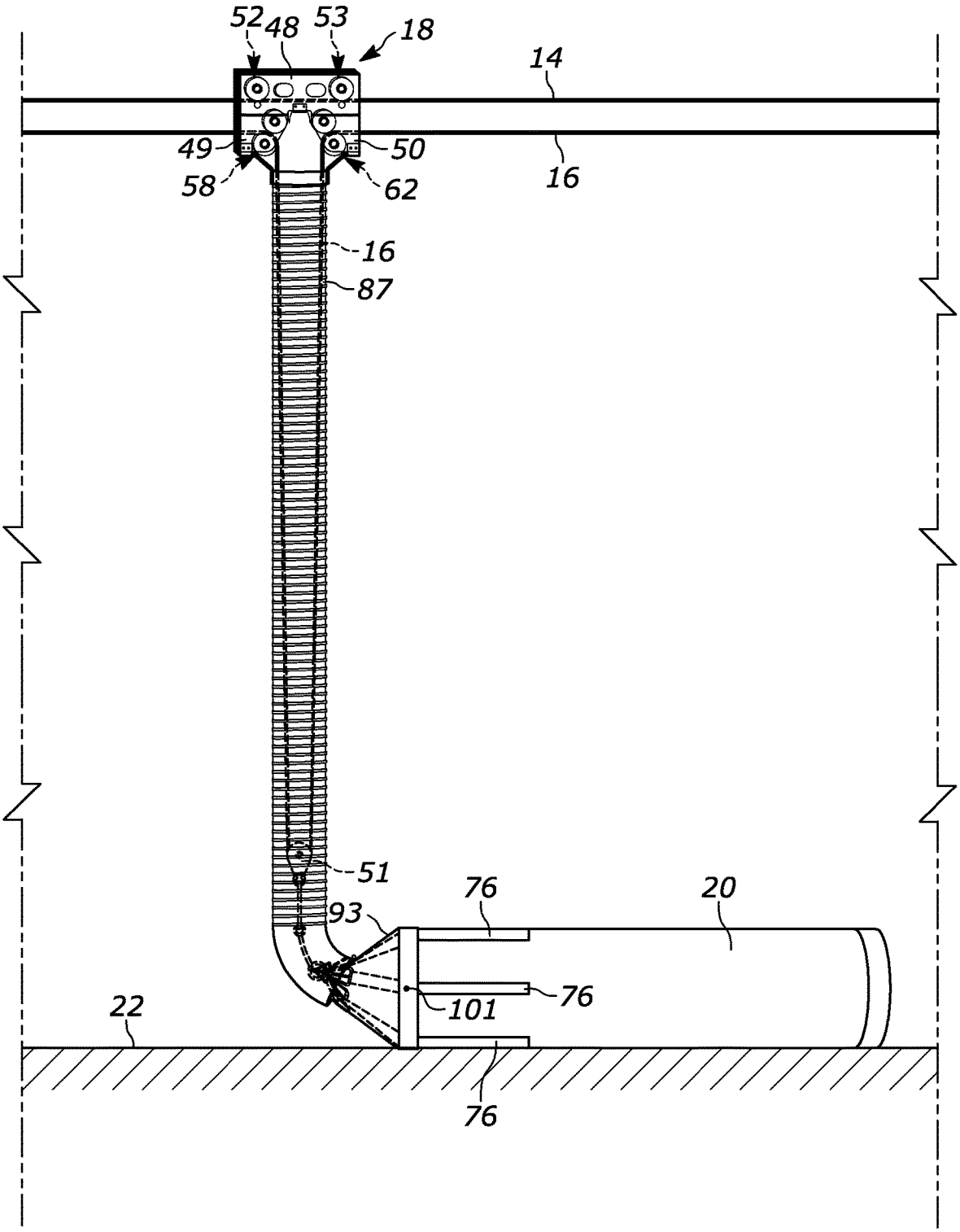
FIG. 11 is front view of the trolley, the attachment assembly and the tackling bag after the tackling bag is tackled.
Figure 12:
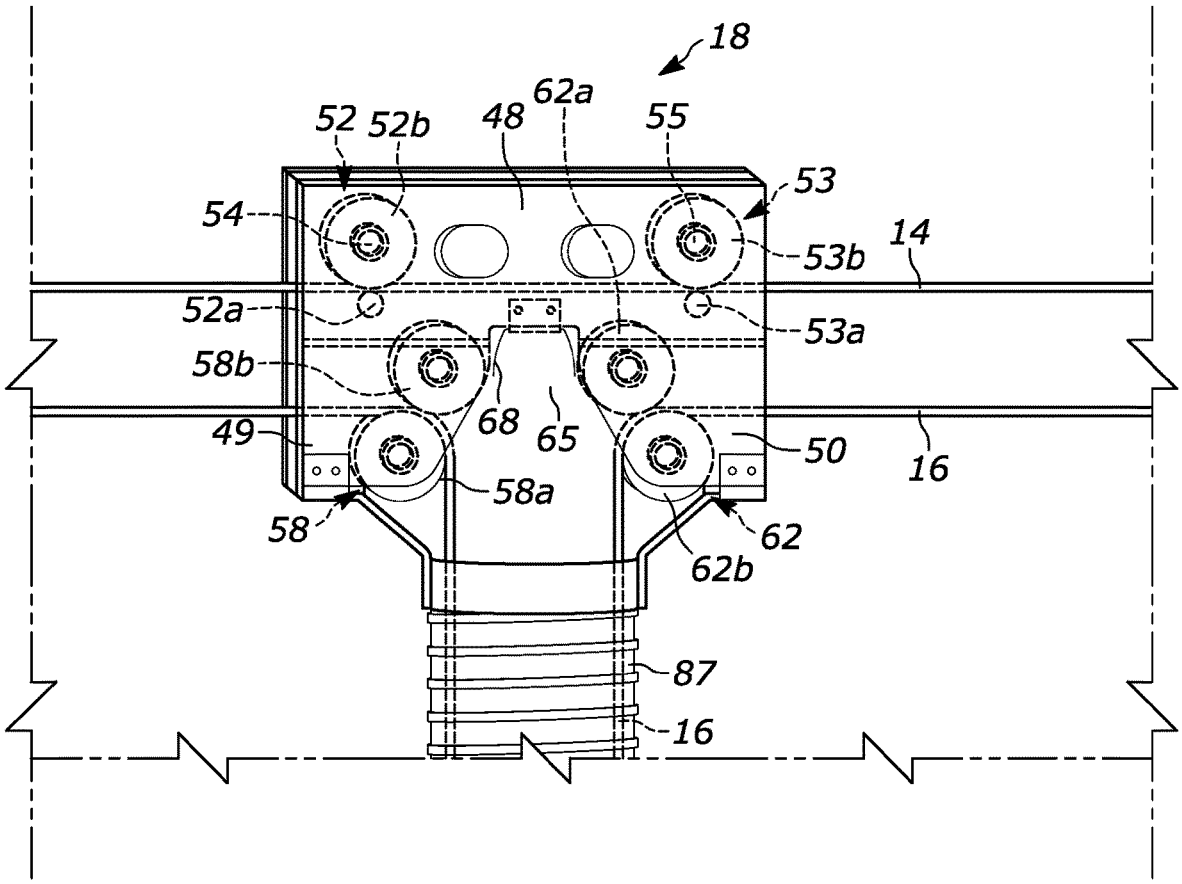
FIG. 12 is a front view of the trolley of FIG. 11.

As shown in FIGS. 1, 2, 7, and 9-12, the rolling mechanism 18 may be connected to the first cable 14 and the second cable 16 and may be configured to traverse the first cable 14 and the second cable 16. As shown in FIGS. 10 and 12, the rolling mechanism 18 may include a first wheel housing 48, a second wheel housing 49, a third wheel housing 50 and a pulley device 51. The first wheel housing 48 may be attached to the second and third wheel housings 49, 50 and may house a first wheel assembly 52 (comprising a peg 52*a* and a wheel 52*b*) and a second wheel assembly 53 (comprising a peg 53*a* and a wheel 53*b*). Each peg 52*a*, 53*a* may be attached to the first wheel housing 48 and each wheel 52*b*, 53*b* may be rotatably attached to the first wheel housing 48. The peg 52*a* may be aligned with an axle 54 of the wheel 52*b* and the peg 53*a* may be aligned with an axle 55 of the wheel 53*b*. The first cable 14 may extend between the first wheel assembly 52 and between the second wheel assembly 53. In this way, the first wheel housing 48 may traverse the first cable 14 from the first end 24 of the first cable 14 toward the second end 25 of the first cable 14.

As shown in FIGS. 10 and 12, the second wheel housing 49 may house a set of wheels 58 (comprising wheel 58*a* and wheel 58*b*). The wheels 58*a*, 58*b* may have the same diameter. Each wheel 58*a*, 58*b* may be rotatably attached to the second wheel housing 49. The set of wheels 58 may be offset from each other (i.e., axles of each wheel 58*a*, 58*b* are offset from one another). The second cable 16 may extend between the set of wheels 58. In this way, the second wheel housing 49 may traverse the second cable 16 from the first end portion 38 of the second cable 16 toward a second end portion 40 of the second cable 16.

As shown in FIGS. 10 and 12, the third wheel housing 50 may house a set of wheels 62 (comprising wheel 62*a* and wheel 62*b*). The wheels 62*a*, 62*b* may have the same diameter. Each wheel 62*a*, 62*b* may be rotatably attached to the third wheel housing 50. The set of wheels 62 may be offset from each other (i.e., axles of each wheel 62*a*, 62*b* are offset from one another). The second cable 16 may extend between the set of wheels 62. In this way, the third wheel housing 50 may traverse the second cable 16 from the first end portion 38 of the second cable 16 toward the second end portion 40 of the second cable 16.

As shown in FIG. 10, the first, second and third wheel housings 48, 49, 50 may define an opening 65 that the pulley device 51 may be disposed in. The pulley device 51 may be attached to the tackling bag 20 (via an attachment assembly 66) and may be movable in a vertical direction relative to the first, second and third wheel housings 48, 49, 50. The pulley device 51 may be positioned between the second and third wheel housings 49, 50 and may be removably attached to the first wheel housing 48 via a clip 68. The pulley device 51 may traverse the second cable 16 from the first end portion 38 of the second cable 16 toward the second end portion 40 of the second cable 16.

Figure 7:
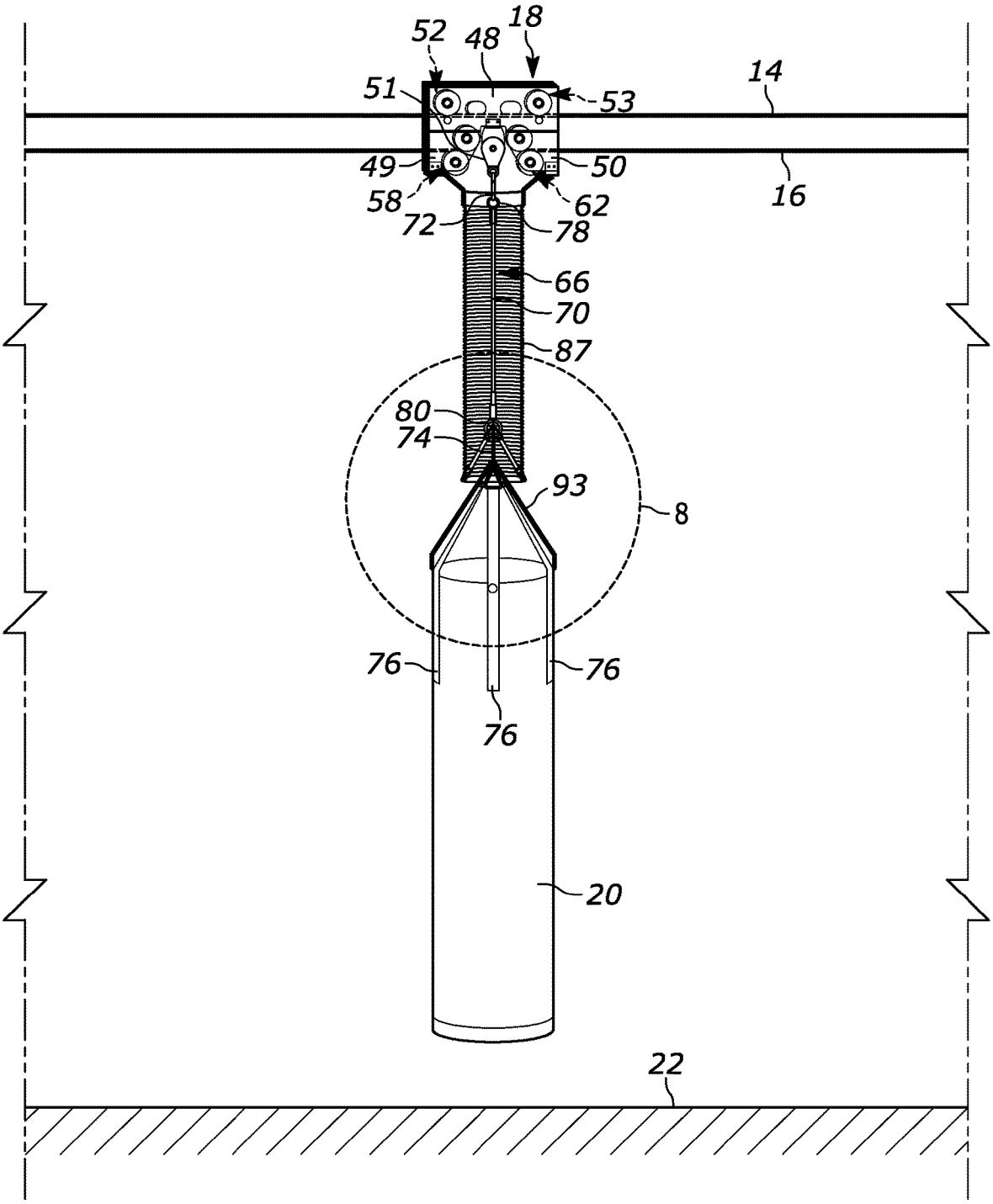
FIG. 7 is a front view of a trolley, an attachment assembly and the tackling bag of the tackling of FIG. 1.
Figure 8:
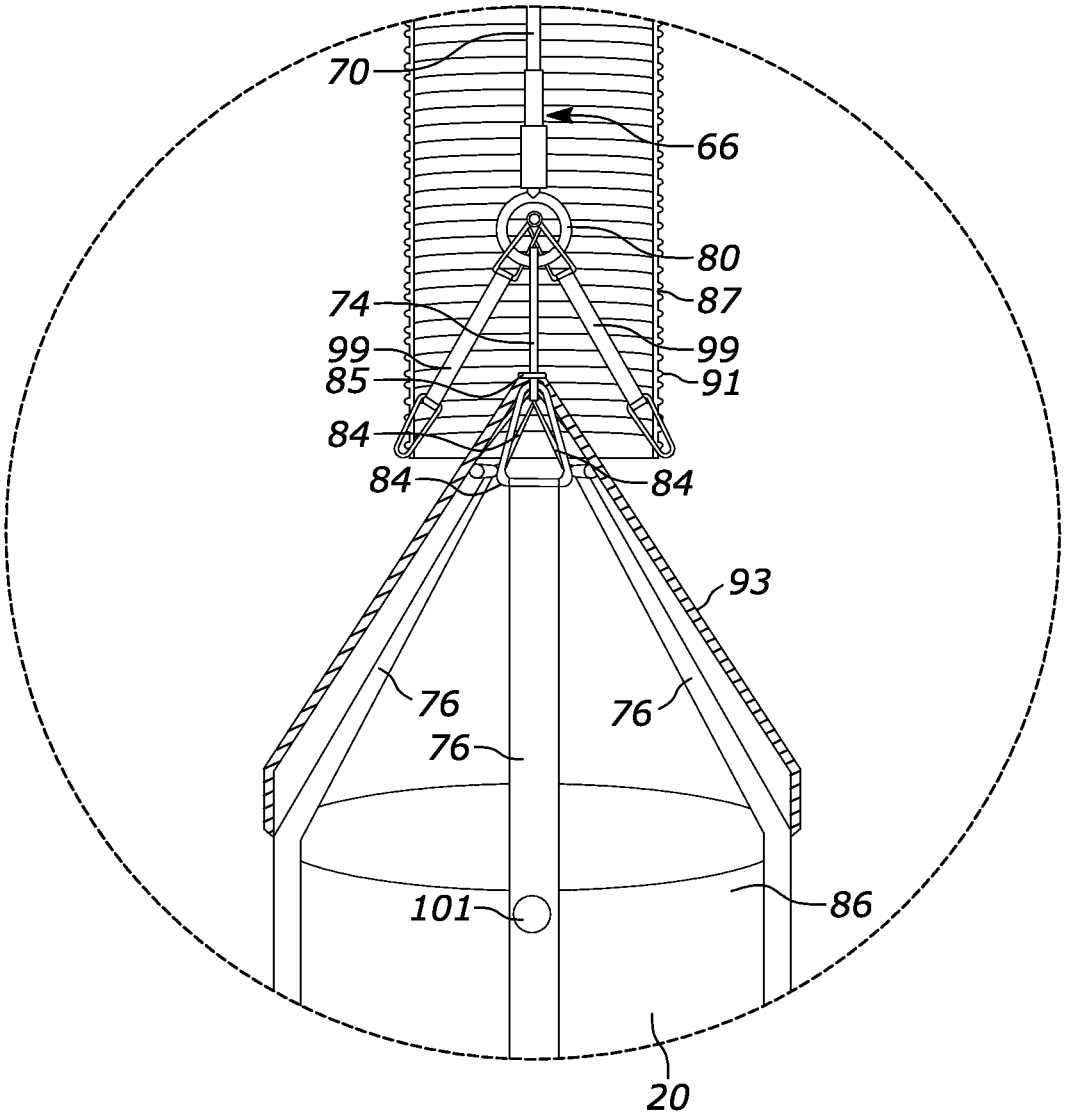
FIG. 8 is a close-up view of a portion of the attachment assembly indicated as area 8 in FIG. 7.

With reference to FIGS. 7, 8, 10, the attachment assembly 66 may include a cable 70, first and second connecting loops 72, 74 (e.g., carabiners) and a plurality of straps 76. The cable 70 may be stretchable and may include rings 78, 80 attached thereto at opposing ends. The ring 78 may be attached to the first connecting loop 72, which, in turn, is attached to a ring 82 of the pulley device 51. The ring 80 may be attached to the second connecting loop 74, which, in turn, is attached to the plurality of straps 76 (via a plurality of hooks 84). The plurality of straps 76 may be disposed around and attached to an upper end 86 of the tackling bag 20. In this way, the pulley device 51 may be attached to the tackling bag 20. The plurality of straps 76 may be made of an unstretchable material.

As shown in FIGS. 7 and 8, a sleeve or a cable shroud 87 may house the cable 70 and at least partially house the first and second connecting loops 72, 74. The sleeve 87 may be made of a stretchable material, for example. For example, the sleeve 87 may be 4 feet in length in its original state (i.e., unstretched) and may be allowed to stretch up to 12.5 feet in length. A first end 89 of the sleeve 87 may be attached to the rolling mechanism 18 via a bracket 88 and a second end 91 of the sleeve 87 may be attached to the ring 80 via strap assemblies 99. A cone-shaped shroud 93 may be attached to a shroud ring 85 and may be attached to the upper end 86 of the tackling bag 20 via attachments 101 (e.g., snap attachments). The shroud 93 may at least partially house the plurality of straps 76 and the plurality of hooks 84.

As shown in FIGS. 1, 2, 7 and 9, the tackling bag 20 may be suspended above the surface 22 a predetermined distance (e.g., a foot) and may be supported by the second cable 16 and the stacked weights 42, 44. The tackling bag 20 may be cylindrical-shaped and may be made of a polyester and/or neoprene material, for example. The tackling bag 20 may be 6 feet in height, for example, and may weigh between 20 lbs and 50 lbs. In some configurations, the tackling bag 20 may include apertures (not shown), which allows air to be released when the bag 20 is tackled, thereby softening the impact experienced by the tackler.

With continued reference to FIGS. 1-16, operation of the apparatus 10 will be described in detail. As shown in FIGS. 1 and 2, the tackling bag 20 may start out adjacent to the first support member 12*a* (or adjacent to the support member 12*b*). Bumpers 90 that are disposed on the first cable 14 at the first end 24 may extend past the first housing 45 such that the rolling mechanism 18 and the tackling bag 20 do not contact the first housing 45 and/or the first pulley system 30. Likewise, bumpers 92 that are disposed on the first cable 14 at the second end 25 may extend past the second housing 46 such that the rolling mechanism 18 and the tackling bag 20 do not contact the second housing 46 and/or the second pulley system 34.

As shown in FIG. 9, a user may propel the tackling bag 20 from a starting position near the support member 12*a* toward the support member 12*b* (or from the support member 12*b* toward the support member 12*a* if the tackling bag 20 starts out adjacent to the second housing 46). In this way, the rolling mechanism 18 may traverse the first cable 14 and the second cable 16 (i.e., the first wheel housing 48 may traverse the first cable 14 from the first end 24 of the first cable 14 toward the second end 25 of the first cable 14, and the wheel housings 49, 50 and the pulley device 51 may traverse the second cable 16 from the first end portion 38 of the second cable 16 toward the second end portion 40 of the second cable 16). While the tackling bag 20 is moving toward the support member 12*b*, a tackler (not shown) may tackle the moving tackling bag 20.

Figure 13:
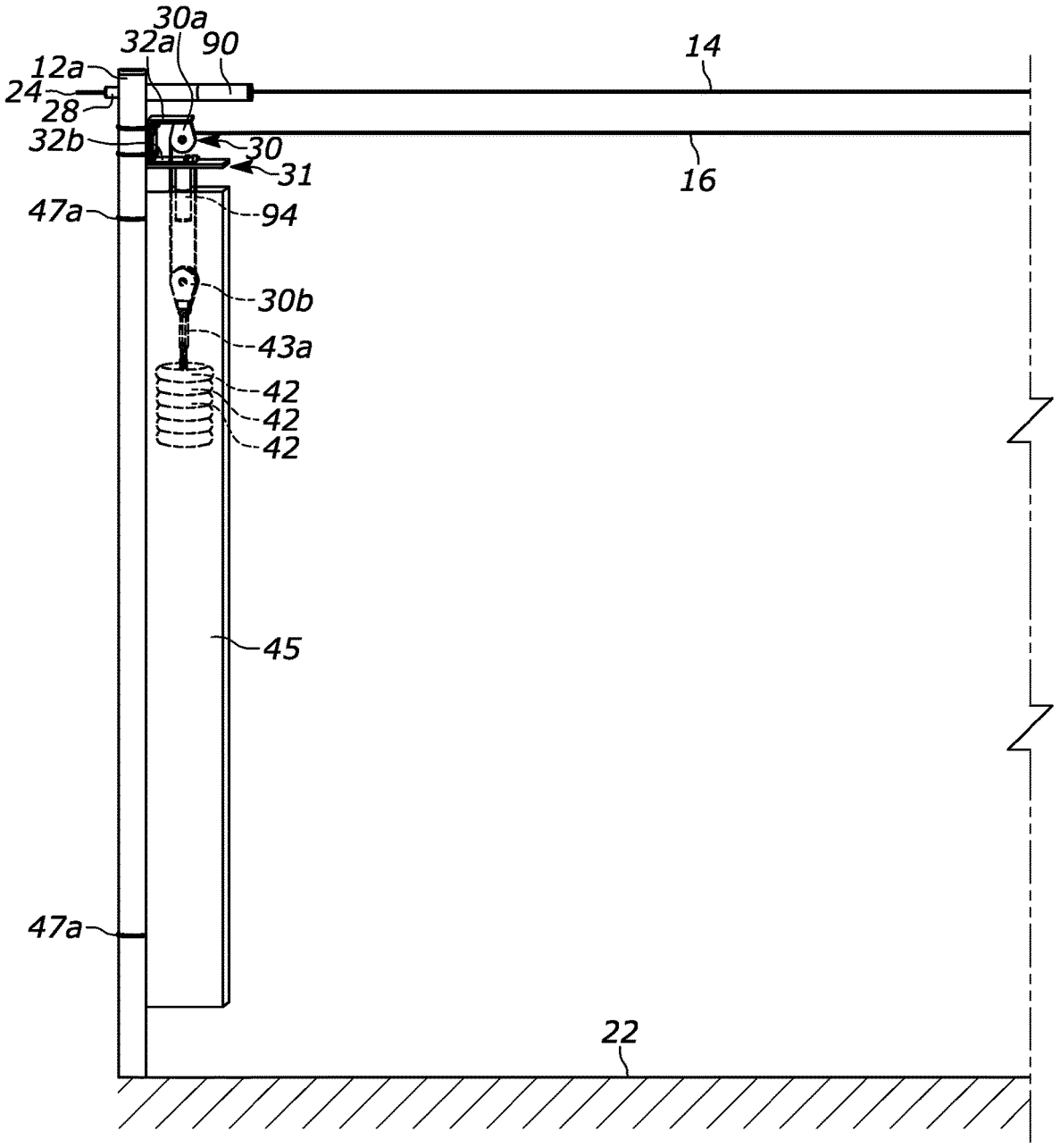
FIG. 13 is a front view of the first pulley system after the tackling bag is tackled.
Figure 14:
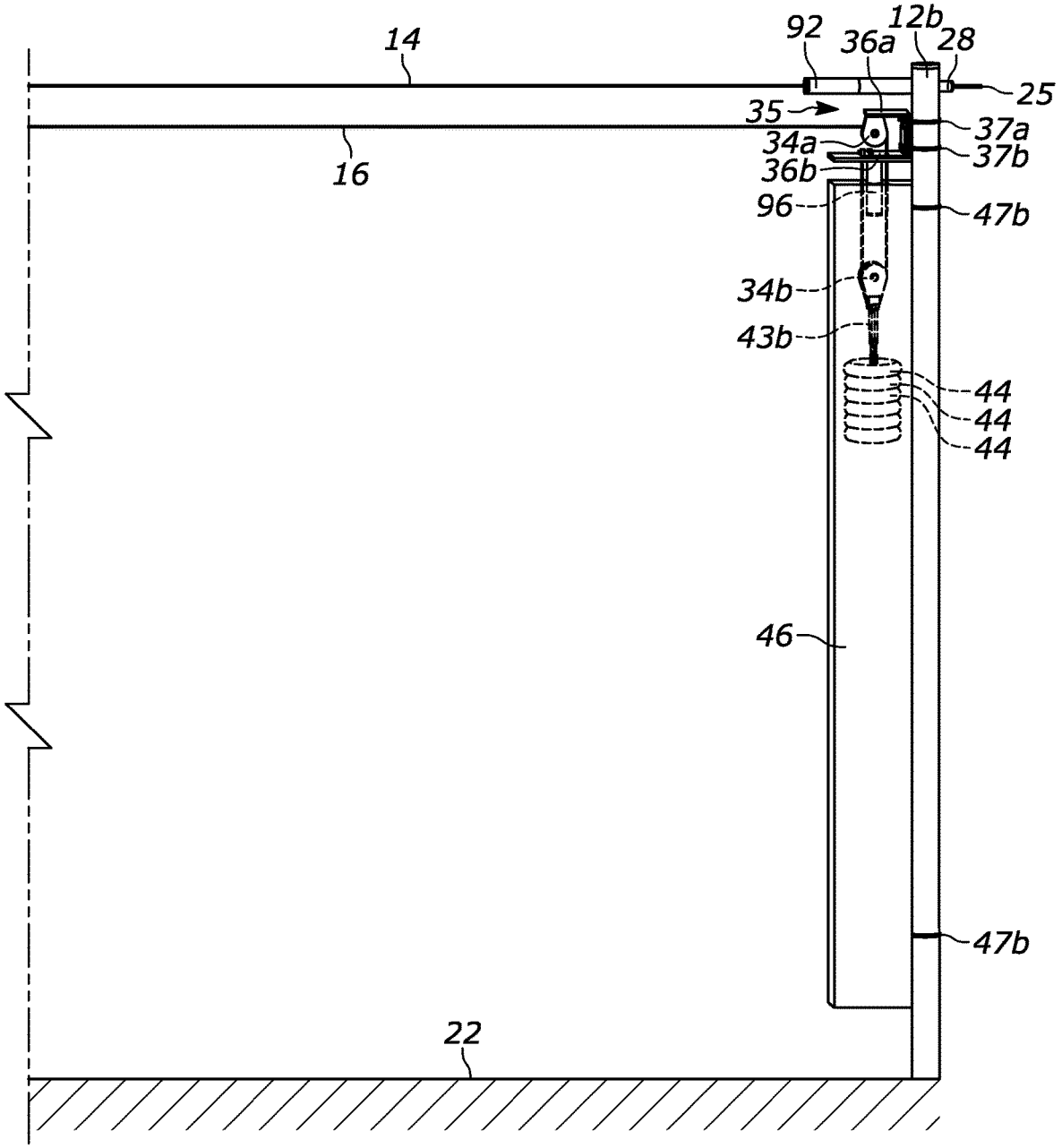
FIG. 14 is a front view of the second pulley system after the tackling bag is tackled.

As shown in FIG. 11, upon tackling the bag 20, the pulley device 51 may be detached from the clip 68 and move downwardly in the vertical direction relative to the first, second and third wheel housings 48, 49, 50, which, in turn, causes a portion of the second cable 16 to extend around the wheels 58*b*, 62*b* and move downwardly in the vertical direction. It should be understood that once the portion of the second cable 16 extends around the wheels 58*a*, 62*b* and moves downwardly in the vertical direction, the rolling mechanism 18 is prevented from continuing to traverse the first and second cables 14, 16. As shown in FIGS. 13 and 14, the stacked weights 42, 44 may move upwardly in the vertical direction (via the pulley systems 30, 34) when the portion of the second cable 16 is moving downwardly in the vertical direction, thereby providing resistance to the tackler that is tackling the bag 20.

As shown in FIGS. 3 and 4, a bumper 94 is attached to the plate 39 to provide a stopping point for the pulley device 30*b* and the stacked weights 42 moving upwardly in the vertical direction when the tackling bag 20 is tackled. Similarly, as shown in FIGS. 5 and 6, a bumper 96 is attached to the plate 41 to provide a stopping point for the pulley device 34*b* and the stacked weights 44 moving upwardly in the vertical direction when the tackling bag 20 is tackled.

Once the tackler disengages from the tackling bag 20, the tackling bag 20 returns to its original position (i.e., the tackling bag 20 is suspended above the surface 22 the predetermined distance). That is, once the tackler disengages from the tackling bag 20, the stacked weights 42, 44 move downwardly to their original position, which, in turn, causes the cable 16 to lift the tackling bag 20 off the surface 22 so that the tackling bag 20 is suspended above the surface 22 the predetermined distance. The user may move the tackling bag 20 back adjacent to the support member 12*a* and repeat the process over again. It should be understood that the cable shroud 87 may cover the cable 70 and may stretch to cover the portion of the second cable 16 that extends around the wheels 58*a*, 62*b* and moves downwardly in the vertical direction when the bag 20 is tackled.

Figure 15:
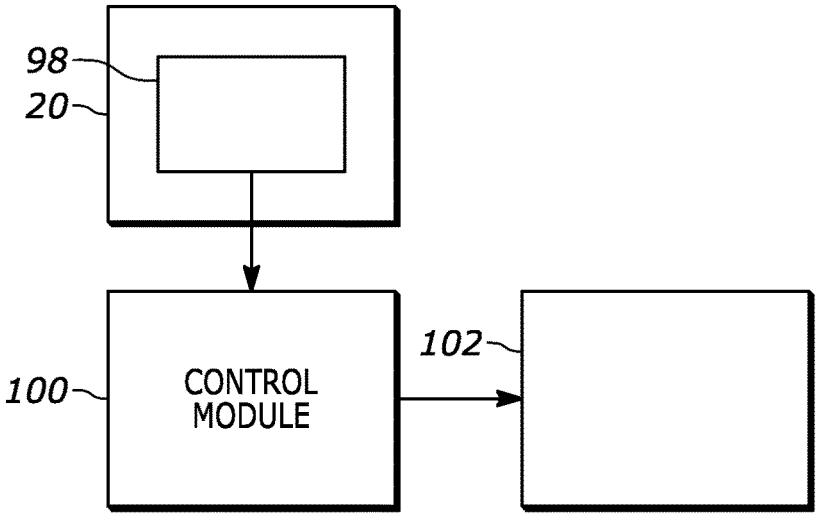
FIG. 15 is a block diagram illustrating communication between a control module, sensors and a notification system.

As shown in FIG. 15, a plurality of sensors 98 may be associated with the tackling bag 20 (e.g., the sensors 98 may be disposed at the upper end 86 and/or a middle portion of the tackling bag 20) and may be adapted to measure a parameter that is indicative of the force applied to the tackling bag 20 when a tackler strikes or tackles the bag 20. For example, the parameter may be a force or pressure applied to the tackling bag 20 when the tackler tackles the bag 20. In another example, the parameter may be an acceleration of the bag 20 when it is tackled, which is used along with the mass of the bag 20 to calculate the force ($F=m\times a$) applied to the tackling bag 20 by the tackler. It should be understood that the plurality of sensors 98 may be disposed at various other locations of the tackling bag 20 (e.g., a lower end of the tackling bag 20).

As shown in FIG. 15, a control module 100 may be in wired or wireless communication with the sensors 98 and may receive data from the sensors 98. The data may include the parameter that is indicative of the force applied to the tackling bag 20. When the control module 100 receives data from the sensors 98, the control module 100 may communicate the data to a notification system 102. The notification system 102 could be a computer, a mobile phone (e.g., smartphone), or a tablet, for example, or any other communication device or network of devices. The control module 100 may be in communication with the notification system 102 via, for example, an internet, Wi-Fi, Bluetooth®, Zigbee®, power-line carrier communication (PLCC), or cellular connection or any other wired or wireless communication protocol.

Figure 16:
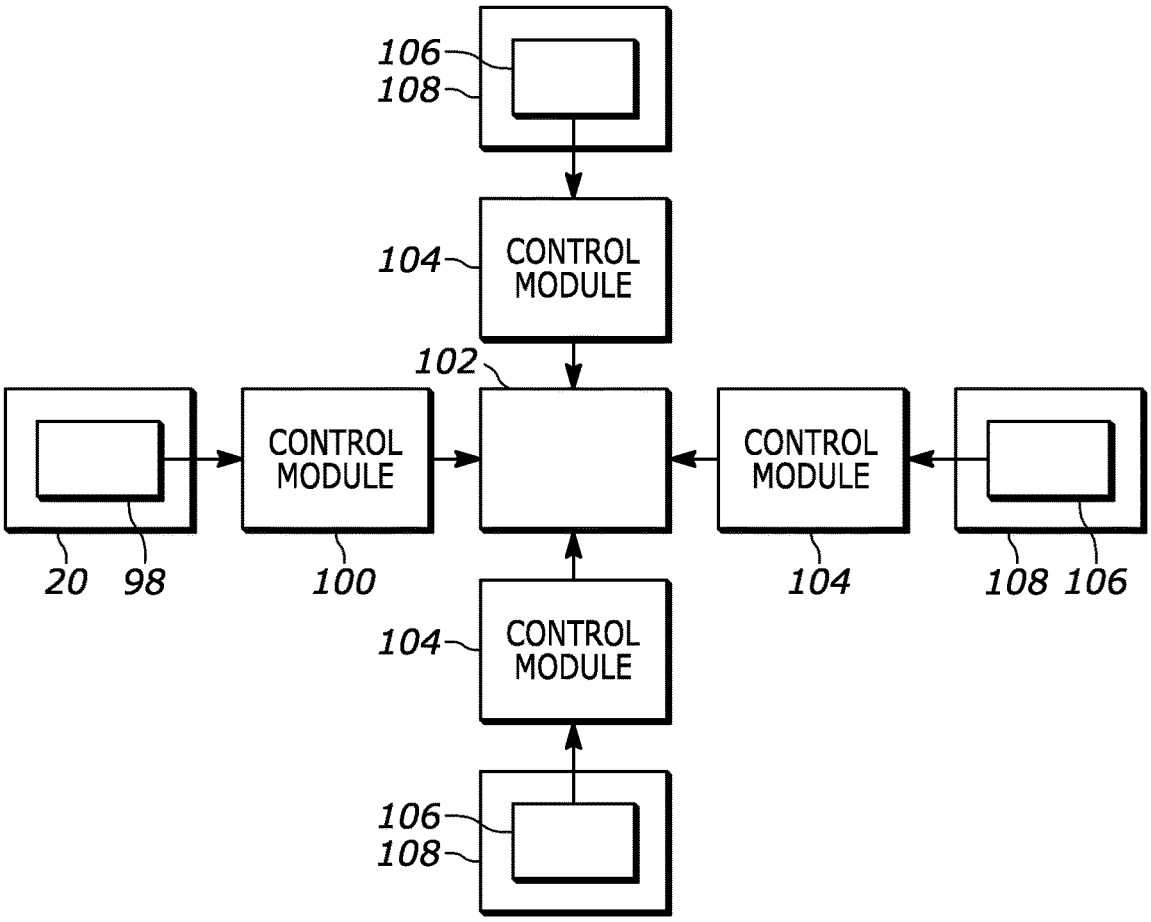
FIG. 16 is a block diagram illustrating communication between control modules, sensors and a notification system.

With reference to FIGS. 15 and 16, the notification system 102 may include data from the control module 100 that is in communication with the sensors 98 associated with the tackling bag 20 and may also include data from other control modules 104 that are in communication with respective sensors 106 associated with respective tackling bags 108. The control modules 104 may be in communication with the notification system 102 via, for example, an internet, Wi-Fi, Bluetooth®, Zigbee®, power-line carrier communication (PLCC), or cellular connection or any other wired or wireless communication protocol. The control modules 104 may also be in wired or wireless communication with the respective sensors 106 and may receive data from the respective sensors 106. The data the control modules 104 receive from the respective sensors 106 may include parameters that are indicative of the force applied to the respective tackling bags 108. In this way, the notification system 102 may include data gathered for various tackling bags 20, 108 for users to view and may alert users when a record force is recorded and communicated to the notification system 102.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term 'module' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "for."

What is claimed is:

1. An apparatus comprising:

a pair of support members fixedly coupled to a surface;

a first cable attached to and extending between the pair of support members;

a rolling mechanism connected to the first cable and configured to traverse the first cable from a first end of the first cable toward a second end of the first cable;

a second cable extending between the pair of support members, the rolling mechanism connected to the second cable and configured to traverse the second cable; and a tackling bag attached to the rolling mechanism and configured to be propelled from one of the pair of support members toward the other of the pair of support members, wherein the rolling mechanism is permitted to move downwardly relative to the first cable when a force is applied to the tackling bag, wherein the rolling mechanism includes first, second and third wheel housings and a pulley device, the first wheel housing attached to the second and third wheel housings and configured to traverse the first cable, and wherein the second and third wheel housings and the pulley device are configured to traverse the second cable.

2. The apparatus of claim 1, further comprising a first pulley system associated with the one of the pair of support members and a second pulley system associated with the other of the pair of support members, and wherein the second cable extends around the first and second pulley systems.

3. The apparatus of claim 2, further comprising a first stack of weights attached to a pulley device of the first pulley system and a second stack of weights attached to another pulley device of the second pulley system, and wherein first and second stack of weights cooperate to act as a counterbalance to the tackling bag such that the tackling bag is suspended above the surface prior to the force being applied to the tackling bag.

4. The apparatus of claim 1, wherein the pulley device is configured to move downwardly relative to the first cable and the first, second and third wheel housings when the force is applied to the tackling bag.

5. The apparatus of claim 4, wherein the pulley device is positioned between the second and third wheel housings.

6. The apparatus of claim 4, wherein the second cable moves in a vertical direction relative to the first cable and the first, second and third wheel housings when the force is applied to the tackling bag.

7. The apparatus of claim 4, wherein the pulley device is removably attached to the first wheel housing via a clip.

8. The apparatus of claim 1, wherein the tackling bag is attached to the rolling mechanism via an attachment assembly.

9. The apparatus of claim 8, wherein a stretchable shroud covers the attachment assembly.

10. An apparatus comprising:

a pair of support members fixedly coupled to a surface;

a first cable attached to and extending between the pair of support members;

a rolling mechanism connected to the first cable and configured to traverse the first cable from a first end of the first cable toward a second end of the first cable;

a second cable extending between the pair of support members, the rolling mechanism connected to the second cable and configured to traverse the second cable; and a tackling bag attached to the rolling mechanism and configured to be propelled from one of the pair of support members toward the other of the pair of support members, wherein the rolling mechanism includes a wheel housing and a pulley device removably coupled to the wheel housing, the wheel housing configured to traverse the first cable and the pulley device is configured to traverse the second cable, wherein the pulley device is separated from the wheel housing when a force is applied to the tackling bag.

11. The apparatus of claim 10, wherein the pulley device is configured to move downwardly relative to the wheel housing when the force is applied to the tackling bag.

12. The apparatus of claim 10, wherein the pulley device is positioned in a space defined by the wheel housing.

13. The apparatus of claim 10, wherein the second cable moves in a vertical direction relative to the first cable and the wheel housing when the force is applied to the tackling bag.

14. The apparatus of claim 10, wherein the pulley device is removably coupled to the wheel housing via a clip.

15. The apparatus of claim 10, wherein the tackling bag is attached to the pulley device of the rolling mechanism via an attachment assembly.

* * * * *